US005873768A

United States Patent [19]

Fleischman-Ament et al.

[11] Patent Number: 5,873,768

[45] Date of Patent: Feb. 23, 1999

[54] ACTIVE-WEAR GARMENT

[75] Inventors: Edie Fleischman-Ament, Northbrook; Susan K. Krueger, Chicago, both of Ill.

[73] Assignee: Edie Fleischman-Ament, Northbrook, Ill.

[21] Appl. No.: 64,119

[22] Filed: Apr. 21, 1998

[51] Int. Cl.[6] ..... A41C 3/00; A41C 3/08; A41C 3/12

[52] U.S. Cl. ..... 450/19; 450/7; 450/41; 450/49; 450/3; 450/58; 450/66; 450/67; 450/36; 450/92; 450/93; 450/70; 450/86; 2/73

[58] Field of Search ..... 2/67, 73, 69, 69.5, 2/105, 106; 450/3, 4, 7, 8, 11, 15, 16, 19, 20, 21, 22, 27, 30, 34, 35, 36, 37, 41, 42, 43, 44, 45, 46, 47, 48, 49, 50, 51, 52, 59, 58, 60, 61, 62, 63, 64, 65, 67, 66, 68, 70, 71, 74, 75, 76, 78, 79, 80, 85, 86, 92, 93

[56] References Cited

U.S. PATENT DOCUMENTS

| | | | |
|---|---|---|---|
| D. 207,629 | 5/1967 | Sachs et al. . | |
| D. 208,758 | 10/1967 | Ramsey . | |
| D. 209,269 | 11/1967 | Tuschman . | |
| 1,576,393 | 3/1926 | Wood . | |
| 2,049,569 | 8/1936 | Price . | |
| 2,304,989 | 12/1942 | Snowdon . | |
| 2,431,829 | 12/1947 | Redares . | |
| 2,438,062 | 3/1948 | Licht . | |
| 2,466,638 | 4/1949 | Denis . | |
| 2,506,639 | 5/1950 | Gordon . | |
| 2,534,721 | 12/1950 | Marshall . | |
| 2,613,365 | 10/1952 | Fairbanks et al. . | |
| 2,623,211 | 12/1952 | Brown . | |
| 2,703,885 | 3/1955 | Davis . | |
| 2,707,281 | 5/1955 | Barth . | |
| 2,760,198 | 8/1956 | Poole et al. . | |
| 2,954,031 | 9/1960 | Froehlich . | |
| 3,021,844 | 2/1962 | Flagg et al. . | |
| 3,114,374 | 12/1963 | Chalfin et al. . | |
| 3,263,685 | 8/1966 | Bernfeld . | |
| 3,380,454 | 4/1968 | Hoelscher . | |
| 3,392,732 | 7/1968 | Holscher . | |
| 3,430,632 | 3/1969 | James et al. . | |
| 3,513,852 | 5/1970 | Seidl . | |
| 3,559,653 | 2/1971 | Jannicello, Jr. . | |
| 3,699,971 | 10/1972 | Hittel et al. | 450/74 |
| 3,779,250 | 12/1973 | Radonski . | |
| 3,896,818 | 7/1975 | Locascio . | |
| 4,235,240 | 11/1980 | Cousins | 450/52 |
| 4,335,641 | 6/1982 | Dastoli et al. . | |
| 4,470,419 | 9/1984 | Di'Tullio . | |
| 5,045,019 | 9/1991 | Capasso et al. . | |
| 5,094,647 | 3/1992 | Courtney . | |
| 5,269,720 | 12/1993 | Moretz et al. . | |
| 5,385,502 | 1/1995 | Moretz et al. . | |
| 5,441,436 | 8/1995 | Moretz et al. . | |
| 5,553,468 | 9/1996 | Osborne | 66/171 |
| 5,643,043 | 7/1997 | Pflum | 450/86 |
| 5,697,830 | 12/1997 | White . | |

*Primary Examiner*—Jeanette Chapman
*Attorney, Agent, or Firm*—Fitch, Even, Tabin & Flannery

[57] ABSTRACT

The present invention provides an active-wear garment which comfortably provides support to the chest and back areas of the physically-active wearer, while wicking away moisture from the skin of the wearer. The active-wear garment of the present invention provides support such that the breasts of the wearer are comfortably supported and effectively immobilized when worn during physical activity of the wearer.

26 Claims, 7 Drawing Sheets

ACTIVE-WEAR GARMENT

BACKGROUND OF THE INVENTION

1. Field of the Invention

The present invention relates to active-wear or shape-wear garments for the chest and back areas of women, or of men who have a need for support to these areas, and particularly to an athletic active-wear garment for controlling breast movement, or to a shape-wear garment, both of which provide effective support for the breast and back areas of the wearer.

2. Background and Description of Related Art

Many women, and some men, require support and control of the chest and/or back areas. Women, particularly, have often experienced problems resulting from a lack of support to the breast and back areas. For example, back pain may result from an overweight condition resulting in particularly large breasts. Even relatively thin women who have naturally large breasts, or who have large breasts resulting from surgical implants, augmentation mammoplasty or the production of milk after childbirth, may have a need for back and/or breast support. Women who have breast cup sizes of D and above are generally carrying approximately five to ten pounds of additional weight, which often results in pain between the shoulder blades.

Known support garments for the chest and back areas have generally not been suitable or appropriate for use as outerwear, including aerobic and other exercise wear, swimwear and other such types of wear. Most breast support garments, such as bras, are worn underneath the clothing worn by the wearer, and could not appropriately be worn on the outside of the clothing.

Further, known bras and athletic support garments for the upper body usually only provide general support to the chest and back areas. Thus, they do not adequately address the needs of the larger breasted women (or men), or women who desire a maximum level of support, control and comfort when worn. In addition, existing athletic support garments and shape-wear garments for the upper body generally do not entirely provide the desired comfort together with the movement control and support to the chest and back areas which are necessary during exercise, athletic activities, such as running, and/or everyday activities which may require, or benefit from, a control of movement to the chest and back areas.

Moreover, most known support garments for the chest and back areas do not have an adequate mechanism for diminishing or eliminating the collection of moisture around the chest and back areas which may develop during exercise and/or everyday activities.

There is currently a need for a garment for the upper body which is capable of providing a significant amount of chest and back support, particularly for large-breasted women, and which is comfortable for the wearer.

The present invention solves the above problems by providing an active-wear or shape-wear garment for the upper body which may be worn either as underwear or as outerwear, which provides a high level of movement control over, and support to, the chest and back areas of the wearer, which has a high degree of moisture control, and which is comfortable.

The active-wear garment or shape-wear garment of the present invention contains contoured, structured breast cups which are incorporated into a smooth elastic fabric panel, and may not solely be worn as an undergarment, such as a shape-wear garment for wear under clothing, lingerie or swimwear, but can also be worn as an outer garment, such as daywear, a category of clothing described as active-wear. Active-wear is often worn when additional back, chest and/or breast support are needed or desired during athletic and aerobic activities. It is often worn in lieu of a bra, and in lieu of other clothing for the upper area of the body, thus, allowing the wearer the comfort and modesty of a bra, while having the look of a daywear top. In addition, the present invention constitutes shape-wear, as well as active-wear, and thus is useful for wear during everyday activities.

SUMMARY OF THE INVENTION

The present invention provides an active-wear garment or shape-wear garment that is effective for controlling the movement, shape and appearance of the breasts of the wearer without necessarily assuming the look of underwear. The present invention, thus, may be used as underwear, or as an outerwear garment, and provides maximum support for the chest and back areas of the wearer, while remaining comfortable, and has a mechanism for moisture control. The active-wear garment or shape-wear garment of the present invention is generally constructed of fabrics which are designed for controlling moisture released from the wearer's skin during exercise, other similar activities and everyday activities.

The active-wear garment or shape-wear garment of the invention provides a significant amount of support to the chest and back areas of wearers, whether small- or large-breasted. The active-wear garment provides such support to each breast of the wearer in at least two ways. First, because four support segments present at the front portion of the garment, which are components of two larger elastic fabric panels present in the garment, which together with the two cups form a front section of the garment, and which surround each of two cups present in the garment, provide uplift to the breasts, substantial uplift is provided to the breasts of the wearer from the portions of the garment which surround the breasts and extend upwards to the shoulder area of the wearer. Second, because the portions of the garment which surround the breasts are attached to a third support segment of a broad band of elastic fabric present at the back of the active-wear garment, there is further support provided around the breasts, and extending under the arm and around to the back upper torso region of the wearer. Thus, support to the chest and back areas of the wearer is simultaneously provided by the elastic fabric panels of the garment up and over the shoulder, as well as around the torso to the back of the wearer.

The active-wear garment of the present invention advantageously provides a significant amount of attractiveness, as well as comfort, to wearers because all of the edges of the fabric segments which are joined during the construction of the active-wear garment are preferably hidden from view, and maintained away from the wearer's skin, by being sealed within interior regions of the garment. The active-wear garment is preferably constructed in a manner which prevents all of the edges of the fabric segments which are joined during the construction of the active-wear garment from being visible when the garment is worn, and from touching the wearer's body, thus providing more aesthetic appeal and general comfort to the wearer, particularly to the athletic wearer. As a result, this active-wear garment should not irritate the wearer's skin by rubbing during athletic or everyday activities.

In addition, the active-wear garment or shape-wear garment of the present invention is attractive because of the materials it is made of, and because of the design and defining style lines of the garment. It is flattering to both small- and large-breasted women when worn as an outer-wear garment.

The active-wear garment of the present invention comfortably supports the breasts and back of a wearer, and is particularly useful for a wearer who is physically active or a wearer who participates in everyday activities.

The active-wear garment of the invention includes: a pair of contoured cups formed from elastic fabric which is sized so as to overlie and snugly encase and support the wearer's breasts; an elastic fabric panel surrounding each of the cups wherein each elastic fabric panel is interconnected with a respective cup and the other respective elastic fabric panel so as to form a front section of the active-wear garment; a flexible, arcuate support wire fixedly positioned along a lower peripheral edge of each of the cups, which extends along an arc of between about 100° and about 135°; a pair of shoulder straps which merge with the upper portions of the elastic fabric panels; a pair of elastic bands which extend along side margins present on each of the shoulder straps, and along upper margins of the elastic fabric panel surrounding a respective one of said cups, so as to form a tear-drop shape therewith; a broad band of elastic fabric extending between, and connected to, the side margins of said front section of said active-wear garment, said broad band of elastic fabric being of a length such that it firmly and snugly fits around the upper back of a wearer when the active-wear garment is worn.

BRIEF DESCRIPTION OF THE DRAWINGS

The present invention, and the advantages thereof, may best be understood from a review of preferred embodiments of the invention, which are illustrated in the drawings, wherein.

DETAILED DESCRIPTION OF THE PREFERRED EMBODIMENTS

Figure 1:
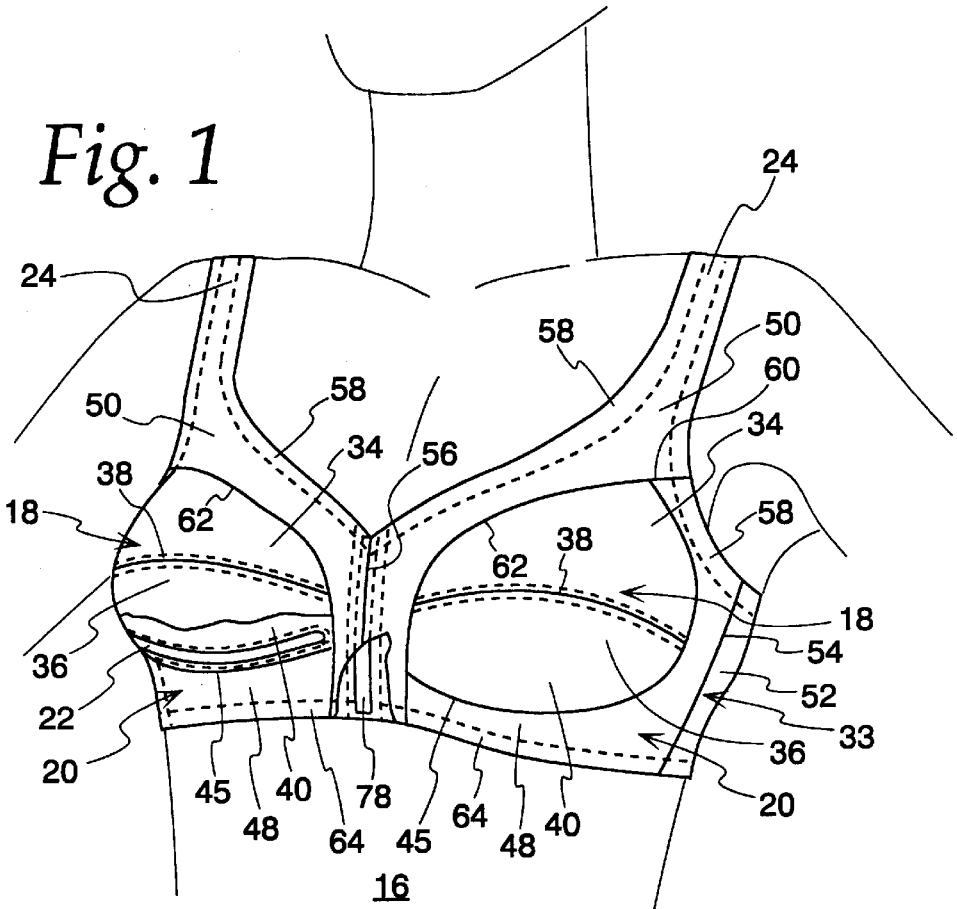
FIG. 1 is a perspective view of the front of a preferred embodiment of an active-wear garment of the present invention seen in place upon a wearer, wherein a cup is fragmented, showing a stay, an arcuate support wire and the seams which are adjacent to them.

The present invention provides active-wear or shape-wear garments (hereinafter "active-wear garment" or "garment") for the chest and back areas of the wearer, which comfortably controls movement of the breasts and provides support for the chest and back areas of the wearer, particularly for the breasts. The active-wear garment has a mechanism for controlling moisture during vigorous movement or everyday activities, and may be comfortably worn either as an under-garment or as an outer garment for the upper area of the body (as active-wear or daywear).

For the purpose of illustrating the active-wear garment of the present invention, there are shown in the drawings, which form a material part of this disclosure, five of the preferred embodiments of the invention.

The various components of the active-wear garments of the present invention may be generally arranged in the manners shown in the drawings, or described hereinbelow. However, the present invention is not limited to the precise arrangements, configurations, dimensions and/or instrumentalities shown in these drawings, or described hereinbelow. These arrangements, configurations, dimensions and instrumentalities may be otherwise, as circumstances require.

A preferred embodiment of the active-wear garments of the present invention will now be described with reference to the drawings. In the drawings, like reference symbols indicate the same parts of the active-wear garments throughout the ten different views thereof.

FIGS. 1–3 and 6–10 show different views of five embodiments of the active-wear garment 16 of the present invention, or parts thereof. The preferred active-wear garment 16 generally includes a pair of contoured cups 18 formed so as to overlie, and snugly encase and support each of the wearer's breasts; an elastic fabric panel 20 formed of segments 48 and 50, surrounding each of the cups 18, wherein the elastic fabric panel 20 is interconnected with a respective cup 18 and the other elastic fabric panel 20 so as to form a front section of the active-wear garment 16; a flexible, arcuate support wire 22 fixedly positioned along a lower peripheral edge of each of the cups 18, each flexible arcuate support wire 22 extending between about 100° and about 135° along the lower peripheral edge of a breast; two pairs of shoulder straps, a pair of front shoulder straps 24 which merge with upper portions of the elastic fabric panel 20 and a pair of back shoulder straps 32 which merge with upper portions of the broad band of elastic fabric 33; a pair of elastic bands 26, which extend along the opposing side margins of each of the front shoulder straps 24, and along upper margins of the elastic fabric panel 20 surrounding a respective one of the cups, so as to form a teardrop shape with the respective cup 18; a broad band of elastic fabric 33 extending between and connected to the side margins of the front section of the active-wear garment, the broad band of elastic fabric 33 being of a length such that it firmly and snugly fits around the upper back of a wearer when the active-wear garment 16 is worn.

The various segments of the active-wear garment 16 may be adjoined by gluing, sewing, heat-adjoining, or any other suitable method for adjoining fabrics, with sewing being the preferred method. Hereinafter, the region where two segments of the active-wear garment 16 are adjoined is called a "seam". It is preferable that all of the seams of the active-wear garment 16 of the invention are configured in a manner that no edges of fabric which are joined during the construction of the garment (seams) are present on the outer surface of the garment 16 (the surface of the garment 16 which does not touch the wearer's skin), or are present on the inner surface of the garment 16 (the surface of the garment which touches the wearer's skin), thereby providing aesthetic appeal to the garment 16 and comfort to the wearer.

Figure 2:
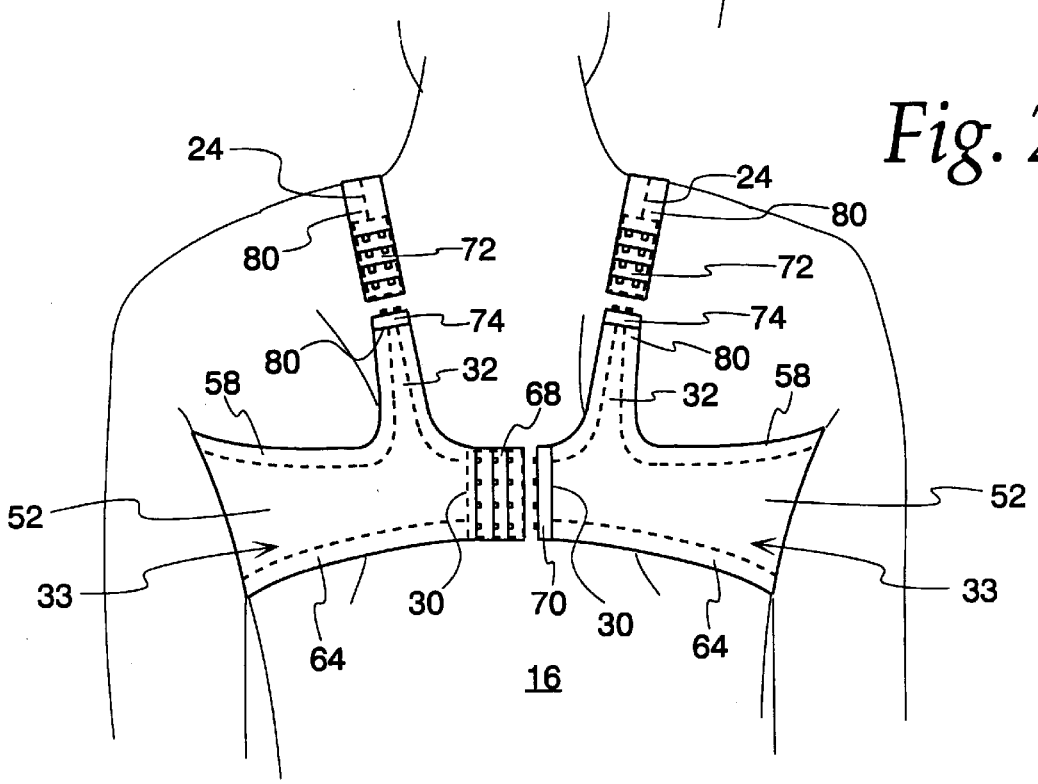
FIG. 2 is a rear elevational view of the active-wear garment shown in FIG. 1 seen in place upon a wearer.

The active-wear garment 16 may be worn by a person, as is illustrated in FIGS. 1 and 2, to achieve support of the back and chest areas, particularly the breasts, with a reduction or elimination in movement of the breasts during exercise, similar activities or everyday use in a comfortable and non-obtrusive manner.

FIGS. 1 and 2 show that the active-wear garment 16 is placed upon a wearer, and then portions of the active-wear garment 16 are removably attached together to secure the active-wear garment 16 upon the wearer. Alternatively, some portions of the active-wear garment may be removably attached prior to placing the active-wear garment upon the wearer, such as the outer ends of the removably attachable shoulder straps, 80.

The two cups 18 of the active-wear garment 16 are contoured and advantageously shape and control movement of the breasts, and provide a comfortable and natural fit for the wearer. When the active-wear garment 16 is worn, the contoured cups 18 should be positioned securely around the breasts of the wearer.

In the embodiment of the invention shown in FIG. 1, each of the cups 18 has two parts, an upper part 34 and a lower part 36, which are securely attached to each other by one of the methods described hereinabove, and preferably by sewing, to form seam 38. The cups 18 formed by parts 34 and parts 36 fit securely around the breasts of the wearer.

The cups 18 may be of any convenient size, such as cup sizes AA, A, B, C, D, DD, E, EE, F, FF, G, and GG. However, the size of the cups 18 employed should be such that they fit securely over the breasts of the potential wearer of the active-wear garment 16.

Embodied within the lower periphery of each cup 18 is a flexible, arcuate support wire 22. The support wire 22 has spring-like qualities, which allow the active-wear garment 16 to regain its original shape when the active-wear garment 16 is not being stressed, for example, when it is placed on a wearer. This support wire 22, thus, allows the garment 16 to return to its original shape after each time it is worn. Thus, the wearer has the feeling of putting on a newly-purchased garment each time that the active-wear garment 16 is worn. The support wire 22 gives the wearer a comfortable feeling of support to the breasts during movement, physical activity, and everyday activity and the attenuated nature of the support wire 22, in comparison with conventional underwires used in brassieres, helps assure that the wearer will not be poked or pinched by the support wire 22 during movement, as often occurs in the use of conventional underwire brassieres.

The support wire 22 is preferably affixed to the seam 45 which is present between the lower portion of the cup 18 and support segment 48 (one of the two segments of each of the elastic fabric panels 20) in the following manner: the support wire 22 is encased in a tube of fabric which is the support wire channel casing 42. Preferably, the channel casing is made of UNPUNCHABLES™ (a trademark of Guilford Mills, Inc.), and the selvages of the fabric segments that are sewn together by seam 45.

The support wire 22 may be a flexible metal wire or polymer tubing which assists in providing support to the breasts during activity of the wearer. The metal may be a titanium alloy or other metals which retain a flexible, spring-like quality, and the polymer may be polyethylene, polypropylene, polyamide, or polyvinylchloride, or the like, in a diameter ranging from about one-sixteenth of an inch to about one-quarter of an inch. The polymer tubing may be hollow or solid. Preferably, the support wire 22 is solid polyethylene tubing having a diameter of about one-eighth inch.

The length and shape of the support wire 22 is critical to the function of the active-wear garment 16.

The support wire 22 has the shape of an arc when inserted in the garment, and differs from conventional underwires used in brassieres in that it acquires the shape of the wearer when the garment is placed on the wearer, in contrast to the industry standard underwire, which is a pre-shaped metal wire which causes discomfort to the wearer because it does not acquire the shape of the wearer when the garment is placed on the wearer. In addition, when the active-wear garment 16 is properly placed upon a wearer, the support wire spans a length of about 100° to about 135° of the lower periphery of the wearer's breast. Conventional underwires, in contrast, span the length of approximately 180° of the lower region of the breast (i.e., the entire lower one-half of the breast).

The end of the flexible arcuate support wire 22 which is closest to the sternum of the wearer (inner end), is preferably located at the portion of seam 62 (wherein the cup 18 is attached with a portion of segment 50 of the elastic fabric panel 20 which is farthest away from the wearer's head, which is closest to the wearer's sternum). The other end of the support wire 22 (outer end) is preferably located below the center area of the side of the breast which is farthest away from the sternum, that is, below seam 38, as is shown in FIG. 1. The support wire 22 can be located at the side portion of the breast from about the center area of this side portion of the breast to about three-quarters of an inch below the center area of this side portion of the breast, along seam 45. Preferably, the outer end of the support wire 22 is located about one-half inch below the center area of this side portion of the breast, along seam 45.

Figure 5:
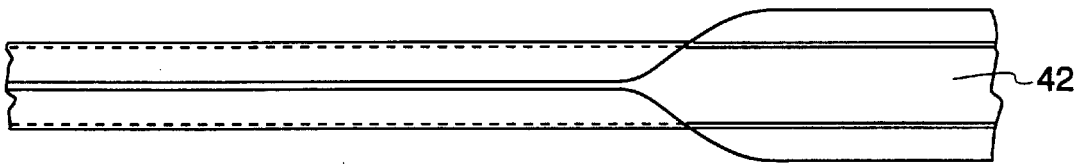
FIG. 5 is an enlarged sectional view of a support wire channel casing.

A pair of arcuate support wire channel casings 42, one of which is shown in FIG. 5, are preferably present in the active-wear garment 16, to securely retain the support wires 22 in a desired position within the garment 16. The support wire channel casing 42 is preferably sewn into the seams 45 that join the cups 18 with segments 48 of the elastic fabric panel 20 at the lower area 40 of the cups 18 as described hereinabove.

The support channel casing 42 is preferably made of the selvages of the segments of fabric joined together by seam 45, as well as an outer fabric which is highly durable, tightly knitted and has a stabilized stitch construction and specialized finish. Although several fabrics have one or more of these qualities, such as taffeta, velush, flannel and nylon, the fabric which is preferable for use as the outer fabric of the support channel casing 42 is a product sold by Guilford Mills, called UNPUNCHABLES™ Pat. Pend. (Guilford Mills, Inc., P.O. Box 26969, Greensboro, N.C. 27419.) The outer fabric of a support channel casing 42 made from one of these materials provides maximum comfort to the wearer without the danger of a support wire 22 (formed of polymer or metal) poking therethrough and, thereby, prevents the support wire 22 from causing lacerations or abrasions to the wearer's skin, and leaving the active-wear garment 16 damaged and unusable. The fabric of which the outer fabric of the support channel casing 42 is made will generally also provide maximum durability for the casing 42 against repeated washings, shrinking, and will help allow the active-wear garment 16 to dry at a rapid pace. The fabric will generally also prevent slippage of the support wire 22 within the garment 16.

The cups 18 of the active-wear garment 16 (and other of the various parts of the garment 16) may be molded or cut by known methods from any fabric which provides support to the breasts of the wearer and which preferably wicks moisture away from the body. Preferably, cups 18 are molded from Meryl™ fabric (Guilford Mills), which provides support while wicking moisture away from the skin. (Meryl™ is a trademark of Nylstar.) Meryl™ is a microfiber that is added to the knitting process to give fabrics a wicking ability and softness to the touch, and is not added as a content fiber. Guilford Mills creates a wickable fabric called Meryl™ fabric which is used for the exterior of the active-wear garment described herein. Another name for such a fabric would be nylon-spandex. Guilford's Meryl™ fabric is eighty-nine percent nylon and eleven percent spandex. The stretchability of the fabric employed to make the cups 18 should range from about 140% to about 220% from side-to-side, and preferably ranges from about 150% to about 210%. The stretchability of the fabric employed to make the cups 18 should range from about 90% to about 150% vertically, and preferably ranges from about 100% to about 135%. There are numerous fabrics which have the above-described characteristics, such as spandex, nylon Lycra™, and Meryl™ fabric, with Meryl™ fabric being preferred. (Lycra™ is a trademark of DuPont.) While the Meryl™ fabric has stretchability in two directions (up and down, and from side to side), most of the stretchability of this fabric is in one direction, side-to-side, when present in a cup 18 of the garment 16 of the invention. Meryl™ fabric promotes moisture management and breathability. Meryl™ fabric draws wetness away from the skin, and generally does not shrink or fade under daily wear and maintenance (washing, drying, etc.). Meryl™ fabric also generally does not pill, pick, run or snag during normal use. Cotton-based fabrics, in contrast, will generally shrink, fade, pill, pick and/or snag during day-to-day wear and maintenance. Further, cotton-based fabrics will generally not draw moisture away from the body, and will usually trap all wetness present on the wearer's skin against the wearer's skin. The cups 18 of the active-wear garment 16 of the invention, as well as other segments of the active-wear garment 16 of the present invention (elastic fabric panel 20, front and back shoulder straps 24 and 32, broad bands of elastic fabric 52, and the like), are also preferably lined on the entire surface which faces the wearer's body with a fabric that wicks away moisture from the wearer's skin. The lining 46 (FIG. 6) preferably spans the entire surface of the active-wear garment 16, but may cover only certain portions of the active-wear garment 16, and may be made of any suitable fabric for lining other fabrics. Fabrics which may be used for the lining 46 include nylon spandex, nylon Lycra™, and Cool Max™-treated fabric. Cool Max™-treated fabric is preferred. (Cool Max™ is a trademark of DuPont.) Cool Max™ is a treatment or process used on fabrics to give certain fabrics a wicking ability. The preferred lining of the present invention is a tecsheen, power net fabric by Guilford Mills and has been treated with a Cool Max™ agent. (Hereinafter the preferred lining material described above manufactured by Guilford Mills will be referred to as "Cool Max™ fabric.") Cool Max™ fabric does not stretch to a large degree in a side-to-side direction, and stretches to a greater degree in the vertical direction. Cool Max™ fabric has a fabric stretchability from about 20% to about 40% in the side-to-side direction and is preferably about 25% to 35%. In the vertical direction, the stretching is about 120–150% and is preferably 130–140%. Cool Max™ fabric is a seventy-nine percent nylon and twenty-one percent Lycra™ fabric. Like the Meryl™ fabric, the Cool Max™ fabric also promotes moisture management and breathability, draws wetness away from the skin, and generally will not shrink or fade under daily wear and maintenance, or pill, pick, run or snag during normal use.

The nature of a netted fabric such as power net, tecsheen, or Cool Max™ fabric, allows moisture to escape from the inner side of the fabric touching the wearer's skin to the outer side of the fabric which is away from the wearer's skin, thus maintaining the moisture away from the wearer's skin. Athletic bras and shape-wear which use a polyester or cotton-based fabric as a lining trap moisture against the wearer's skin, and become worn down during daily use of the bras.

The garment of the invention utilizes a third layer of fabric, which is a power-netted layer of fabric in segment 48 of the elastic fabric panel 20, which is positioned between the lining preferably made of Cool Max™ and the exterior fabric layer preferably made of Meryl™, which layer will be discussed hereinbelow. This third layer of fabric may be any power-netted fabric such as a nylon Lycra™, or spandex. This layer of fabric preferably has a fabric stretchability of from about 10% to about 25% side-to-side, and about 80% to about 110% up-and-down.

The stretchability characteristics of the preferred fabrics for use in the active-wear garment 16 and lining 46, Meryl™ and Cool Max™ fabrics, respectively, advantageously provide the active-wear garment 16 with a high level of movement control over the chest and back areas of the wearer, and particularly the breasts. Athletic bras which do not use such fabrics do not provide support to the wearer in the region of the sternum, along the external lower quadrant of the breast or under the arm and back areas.

The preferred materials for use as the outer layer of the active-wear garment 16 of the present invention such as the Meryl™ fabric are available in a variety of attractive colors, such as turquoise, coral, powder blue, black and pale green, which provide for an attractive and versatile outerwear garment. In addition, such materials are available in an embossed style, which can further add attractiveness to an active-wear garment of the invention. This is in contrast to the industry standard of athletic bras which are available generally in white, gray or black.

In parts 34 and 36 of the cups 18 of the active-wear garment 16, or in cups 18 having one or multiple parts, the Meryl™ fabric is positioned in a manner that it stretches mainly in the side to side direction. In the same cups 18, the Cool Max™ fabric used for the lining 46 is positioned in the manner that it stretches, for the most part, in the up and down direction. Thus, a high level of support, and a low level of stretchability, is provided to the cups 18 in the use of Meryl™ fabric as the outer fabric of the cups 18, and Cool Max™ fabric as the lining 46 of the cups 18.

Figure 6:
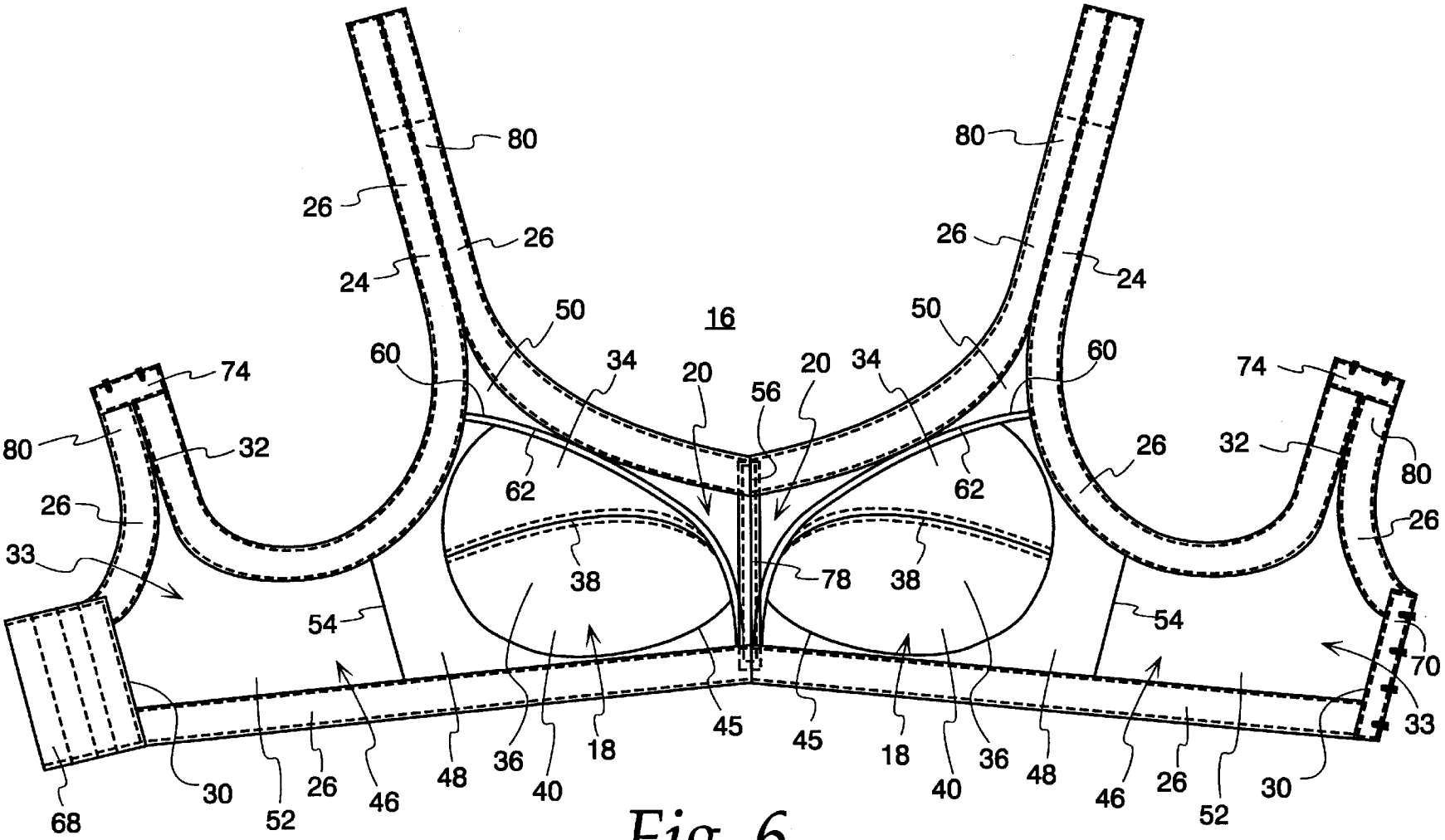
FIG. 6 is a front elevational view of the underside of the active-wear garment shown in FIG. 1, which rests upon a wearer's body.

The fabric used as the lining 46 creates the infrastructure around the contoured cups 18 of the active-wear garment 16. The two-way stretchability of the lining 46 allows the active-wear garment 16 to maintain its shape at all times. This fabric for the lining 46 also provides support and control for the Meryl™ fabric around the breast and back areas. The entire active-wear garment 16 is preferably lined with a wickable fabric, with the lining 46 being attached to the Meryl™ (or other) fabric used for the active-wear garment 16 by sewing, gluing or other known methods, preferably, as shown in FIG. 6. At each place on the active-wear garment 16 two or more portions of the active-wear garment 16 are attached together (between parts 34 and 36 of the cups 18, between the cups 18 and the elastic fabric panel 20, etc.), and preferably in a manner that no edges of fabric adjoining different segments of the active-wear garment 16, or the lining 46, are exposed to the wearer's skin when wearing the active-wear garment 16, or on the outside of the garment 16. The lining 46 allows the active-wear garment 16 to rest comfortably against the wearer's skin, provides support in the use of fabrics with limited stretchability, and wicks away from the wearer's skin moisture which accumulates during physical activity, or moisture which naturally builds up during wear.

The active-wear garment 16 has two elastic fabric panels 20, a first and a second elastic fabric panel 20. Each elastic fabric panel 20 encircles the peripheries of the breasts, and extends over the wearer's shoulders and connects with and to the broad band of elastic fabric 33 which extends around the wearer's torso, side and back areas (beneath the underarms and shoulder blades). Each of the two elastic fabric panels 20 has two seamed segments, 48 and 50, which are attached to each other by gluing, sewing or other known methods. Each cup 18 of the active-wear garment 16 has its periphery bordered by the two segments (segments 48 and 50) of the elastic fabric panel 20. As is shown in FIG. 1, segments 48 border the sides of the cups 18 which are near the side of the wearer's body, and the lower edges of the cups 18, and segments 50 border the upper edges of the cups 18 and the sides of the cups 18 which are near the wearer's sternum, and extend upwards into front shoulder straps 24. Segments 48 and 50 are attached to each other, and to the cups 18, at the juncture where those components of the active-wear garment 16 meet (FIG. 1 and FIG. 3) in any suitable manner, as described hereinabove, and may be removably (partially or fully) or non-removably attached to the cups 18 in the manner described hereinabove, depending upon whether the garment 16 is intended for use by nursing mothers FIG. 8. As shown in FIG. 2, each segment 52 of the broad band of elastic fabric 33 rests on the wearer's back, and includes an upward extension which forms part of the back shoulder straps 32. Segments 48 and 52 are attached to each other at the seam where these two segments meet 54 (FIG. 3) in any suitable manner as described hereinabove.

The margins of segments 50 of each of the two elastic fabric panels 20 which are closest to the wearer's sternum are connected with each other, and are preferably bordered by a center front seam 56. The upper areas of these segments 50 preferably are bordered by a top border 58 of the active-wear garment 16, which forms a curved segment which extends upwards to form the lower portion of the front of a shoulder strap 24. Segment 50 of the elastic fabric panel 20 is attached to the top of segment 48 of the elastic fabric panel 20 at seam 60, and is also attached to a portion of the cups 18 which is near the wearer's sternum and the wearer's head, and which is bordered by seam 62.

Segment 48 of the elastic fabric panel 20 is attached to segment 50 in two locations, at the top, outer portion (portion farthest from the wearer's sternum) of the cups 18 at seam 60, and the at the lower sternum area of the wearer, as is shown in FIG. 1, and is attached to segment 52 of the elastic fabric panel 20 along the side of segment 52 nearest the underarm of the wearer at seam 54. Segment 48 is also attached to the lower periphery 40 of the cups 18 at seam 45, and to the sides of the cups 18 which are farthest from the sternum (FIG. 1). The portion of segment 48 which is beneath the cup should range in width from about three-quarters of an inch to about one and one-half inches in width, and is preferably about one inch in width.

The seam or other area formed by attaching the lower periphery 40 of the cups 18 with the segments 48 of the elastic fabric panels 20 provides an area of the active-wear garment 16 where the arcuate support wire 22 may be inserted within the active-wear garment 16 to provide support to the lower area of the wearer's breasts, called an arcuate support wire channel casing 42 (FIG. 5).

Figure 3:
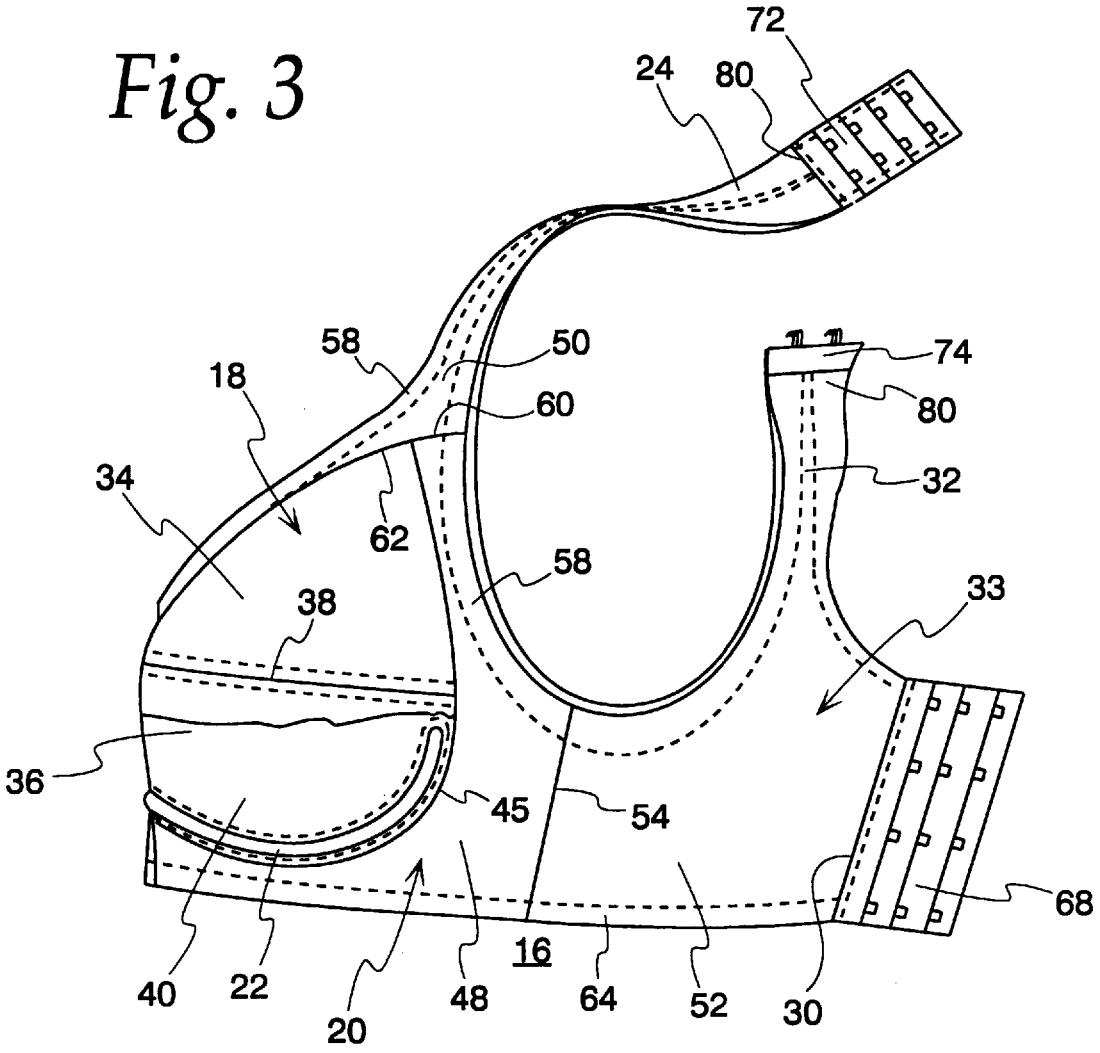
FIG. 3 is another perspective view of the active-wear garment shown in FIG. 1 in which the shoulder straps are unattached and showing a fragmented view of a cup which shows an arcuate support wire and seams which are adjacent to it.
Figure 4:
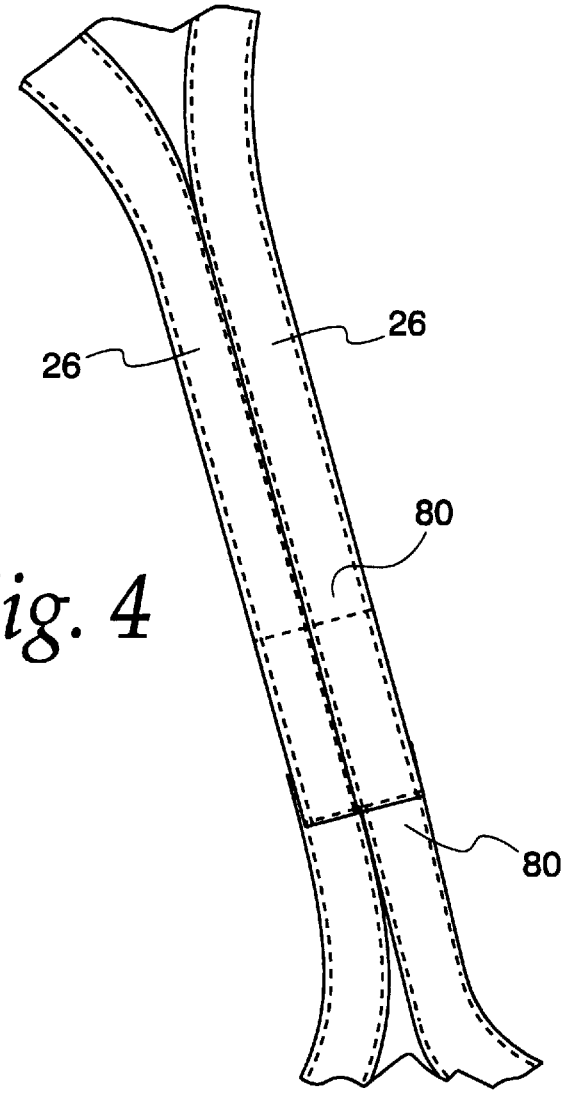
FIG. 4 is an enlarged sectional view of the underside of one of the shoulder straps of the active-wear garment shown in FIG. 1, which rests upon a wearer's shoulder, showing woven elastic present along both hemlines of the shoulder strap.

Segments 48, 50 and 52 preferably have a bottom border 64 which is preferably bordered with a woven elastic band 26. The woven elastic band 26 is preferably sewn through the lining 46 (FIG. 6) and the exterior Meryl™ fabric, and rests against the wearer's skin. Similarly, a woven elastic band 26 preferably is sewn through (FIG. 6) the lining 46 and the exterior Meryl™ fabric present at the entire upper portion of the garment 16. The woven elastic band 26 that borders segment 50 of the elastic fabric panel 20 nearest to the wearer's head and extends to form part of the shoulder straps 24 and 32 is designated as 26 in FIG. 6. The woven elastic band that borders the top border of segments 48 and 50 of the elastic fabric panel 20 and segment 52 of the broad band of elastic fabric and is farthest from the wearer's head is designated as 26 in FIG. 6. The woven elastic band that borders the bottom border of the segments 48 and 50 of the elastic fabric panel 20 and segment 52 of the broad band of elastic fabric 33 and is farthest from the wearer's head is designated 26 in FIG. 6. Such woven elastic band 26 may extend from about one-half of an inch to about one inch in width, and is preferably about three-quarters of an inch in width. The woven elastic band 26 can vary from about one-thirty-second of an inch to about three-sixteenths inch in thickness, with about one-sixteenth of an inch in thickness being preferred. Elastic fabric panel 20 segments 48 and 50, and in segment 52 of the broad band of elastic fabric and shoulder straps (front) 24 and (back) 32 preferably have a top border 58 which is preferably bordered with a woven elastic band 26 which is as described above for bottom border 64, and which is preferably sewn through the lining 46 and the exterior Meryl™ fabric (FIG. 6), and also rests against the wearer's skin. The top border 58 of the active-wear garment 16 preferably extends from interior finished seam 56 (attached to segment 50) along the entirety of both sides of the shoulder straps 24 and 32 (FIG. 6) which are nearest to the head of the wearer. Top border 58 also extends from the end of front shoulder strap 24 (the portion of the front shoulder strap 24 which is the farthest away from cups 18) along the entire side of the shoulder strap 24 which is away from the head of the wearer under the arm, to back straps 32, which preferably removably attach to shoulder straps 24 at a point which rests on the wearer's shoulder blades (FIGS. 2 and 3). The top border 58 further preferably extends from the ends of the back straps 32 (the portions which removably attach to the front shoulder straps 24) down to the side of segment 52 of the elastic fabric panel 20 which is furthest away from the cups 18 (FIG. 2). The woven elastic band 26 which extends along top border 58 and bottom border 64 is preferably attached to the borders by a two-step zig-zag stitched seam.

Figure 10:
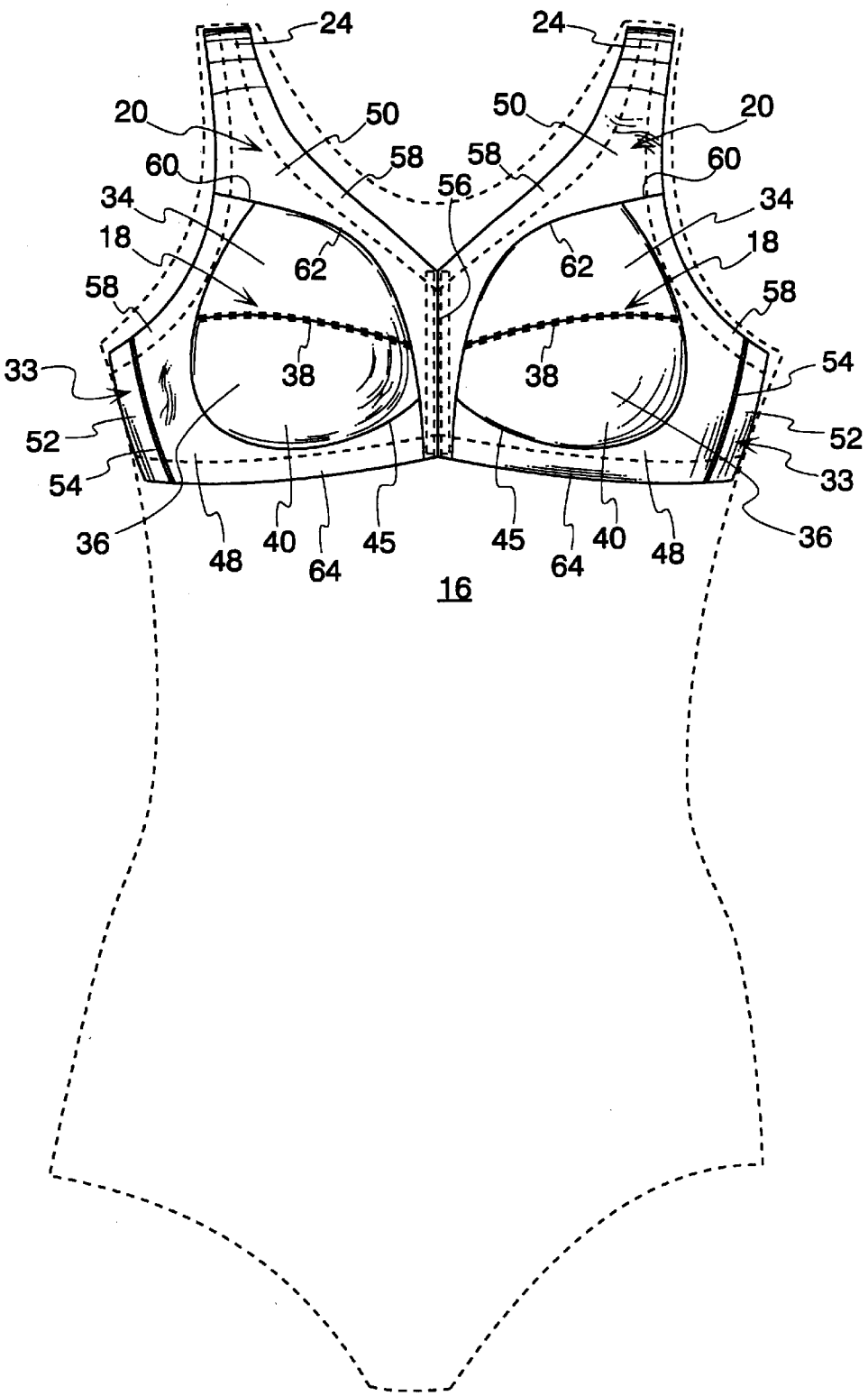
FIG. 10 is a front elevational view of the active-wear garment of the present invention, which is sewn in place inside of a women's one-piece swimsuit, depicted by phantom lines.

The bottom border 64 is oriented in a generally horizontal position upon a standing wearer, as can be seen in FIGS. 1, 2 and 10. The bottom border 64 is preferably present along the entire length of the lower area (the area away from the wearer's head) of the active-wear garment 16. It extends from the outer free end 30 of one of the two segments 52 along the entire length of the active-wear garment 16 to the outer free end 30 of the other of the two segments 52. The length of the active-wear garment 16 along the bottom border 64, or from one end of the active-wear garment 16 farthest from seam 56, to the other end of the active-wear garment 16 which is farthest from seam 56, is an indication of the chest size of the wearer. Active-wear garment 16 chest sizes will generally range from about 28 inches to about 46 inches. The chest size varies in even increments, so that the chest sizes for the garment 16 available will generally be 28, 30, 32, 34, 36, 38, 40, 42, 44 or 46.

In segments 50 of the elastic fabric panel 20 and in segments 52 of the broad band of elastic fabric 33 of the active-wear garment 16, although any of several stretchable, wickable fabrics, such as Meryl™ fabric or Cool Max™ fabric, may be used as described hereinabove, one layer each of Meryl™ and Cool Max™ fabrics are preferably used. The Meryl™ fabric and Cool Max™ fabric is positioned in these segments of the active-wear garment 16 in a manner that they each mainly stretch in the opposite direction from one another, with the Meryl™ fabric having greater stretch up and down, thus lending greater stretchability to these two segments of the elastic fabric panel 20 of the active-wear garment 16. In contrast, in segments 50 and 52 of the garment 16 the lining of Cool Max™ has a greater stretch from side to side. Preferably, the Meryl™ fabric will be positioned on the outside of the active-wear garment 16 (away from the wearer's skin), and the Cool Max™ fabric will be used as the lining 46 which rests upon the wearer's skin. This is consistent with the applicant's goal of making an active-wear garment which snugly fits around the torso, so as to not permit slippage of the garment during activity, and to thereby more firmly support, shape and immobilize the breasts during athletic activities and during everyday activities.

In segment 48 of the elastic fabric panel 20 of the active-wear garment 16, there may be used, for example, one layer of Meryl™ fabric and one layer of Cool Max™ fabric. The Meryl™ fabric is preferably oriented to stretch in the up and down direction, giving the panel the most stretch in the vertical direction. Preferably, for added support in segment 48, three layers of fabric are used: one layer of Cool Max™ fabric, which is oriented in the direction such that it stretches side to side, another layer of a power net fabric (not necessarily Cool Max™) which stretches in the side to side direction, and a third layer of Meryl™ fabric oriented to stretch in the up and down direction. Such an orientation of the three layers of fabric give maximum support, control, and comfort. The Meryl™ fabric will preferably be on the outside of the active-wear garment 16 (away from the wearer's skin), with the Cool Max™ layer, functioning as the lining 46 of the active-wear garment which touches the wearer's skin, and with the other layer of power-net fabric positioned between the Meryl™ fabric and the lining 46.

The outer free ends 30 of the two segments 52 of the two broad bands of elastic fabric 33 (FIG. 2) preferably have devices which permit the outer free ends 30 to be removably attached (if the active-wear garment 16 is to be opened from the back (FIGS. 2 and 3)), or nonremovably attached (if the active-wear garment is to be opened from the front (FIG. 9)) with one another to form the back portion of the active-wear garment 16 into one continuous band which will remain in place around a wearer's torso. Such non-removable attachment may be by sewing, gluing of the segments 52, or by other known permanent means of joining the two segments 52 of the broad bands of elastic fabric 33 together. Alternatively, a single piece of fabric could be utilized to construct the broad band of fabric 33 in an embodiment of the garment which is removably attached at the front of the garment. Preferably, outer ends 30 of the two segments 52 of the two elastic fabric panels 20 are removably attachable, such that the active-wear garment 16 may be opened at this location.

The removable attachment of the outer free ends 30 of the two segments 52 of the elastic fabric panels 20 together is described hereinbelow. The broad band of elastic fabric 33 is, at the outer free ends 30 of such broad band, or in the case of an active-wear garment which is removably attachable at the front of the active-wear garment, about two inches to about four inches in width, from top border to bottom border at the broad band of elastic fabric, and is preferably about three and one-quarter inches in width at that site. Preferably, as shown in FIGS. 2 and 3, the outer free end 30 of the segment 52 of the first broad band of elastic fabric 33 which is to rest to the left of the upper center area of the wearer's back (when facing the wearer's back) has an approximately two and one-quarter inch strip of metal loop tape 68 attached within the seam of the outer free end of segment 52, which contains three vertical rows of loops, with each vertical row of loops containing four loops, with the first row of loops being positioned one-half inch away from the outer the edge of such loop tape 68, and with each of the vertical rows of loops being spaced apart by approximately one half of one inch. Each loop in a vertical row of loops is preferably spaced from another loop in the row by about three-quarters of an inch. Preferably, and as shown in FIGS. 2 and 3, the outer free end 30 of the other segment 52 of the second broad band of elastic fabric has an approximately one-half inch strip of metal hook tape 70, that is sonic sealed, containing one row of four hooks which are spaced apart by about three-quarters of an inch. These hooks and loops, when combined in one of the three possible positions (the first, second or third row of loops), provide maximum security, support and comfort to the wearer, and will allow the fit of the active-wear garment 16 to be significantly adjusted. The tapes 68 and 70 are preferably attached to the outer free ends 30 of the segments 52 of the broad band of elastic fabric 33 by a narrow zig-zag stitch from a sewing machine that is tacked in each corner.

Figure 9:
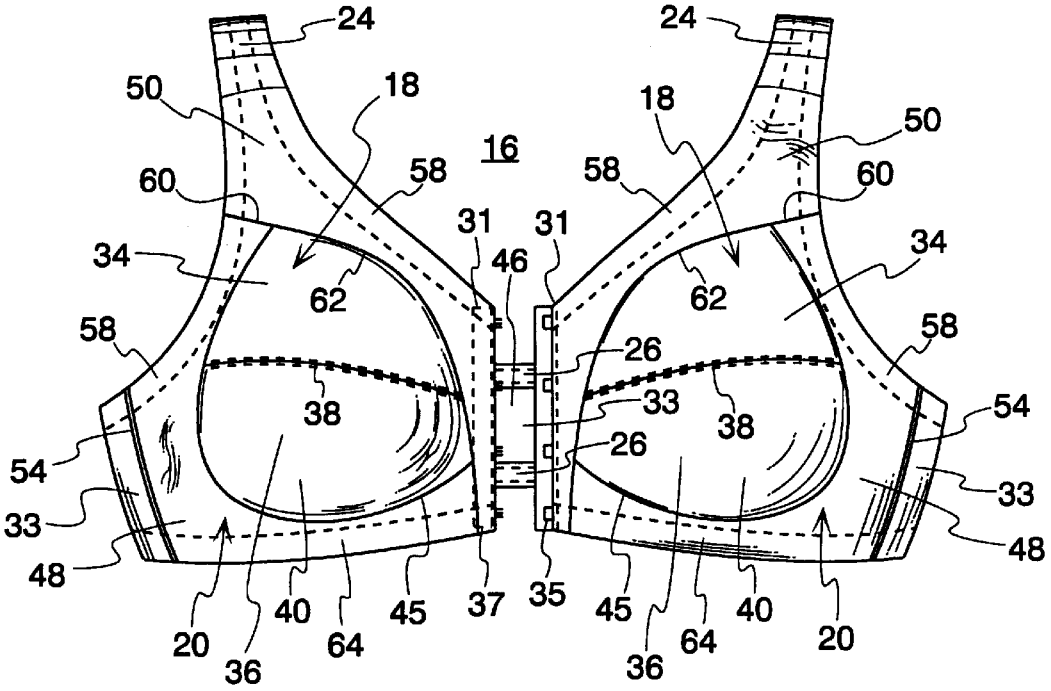
FIG. 9 is a front elevational view of another preferred embodiment of the active-wear garment of the present invention which is removably attachable around the torso of a wearer at the front of the active-wear garment.

When the joining of the two segments 52 is permanent, then the active-wear garment 16 should be removably attachable between the two segments 50 of the elastic fabric panels 20 at seam 56 as shown in FIG. 9. Preferably, as shown in FIG. 9, the outer free end 31 of the segment 50 of the elastic fabric panel 20 which is to rest at the right of the center area between the wearer's breasts (when facing the wearer's chest) has an approximately one-half inch strip of metal loop tape 35 attached within the seam of the outer free end 31 of segment 50, which contains at least one vertical row of loops, with each vertical row of loops containing four loops, with the first row of loops being positioned one-half inch away from the outer edge of such loop tape 35. Each loop in a vertical row of loops is preferably spaced from another loop in the row by about three-quarters of an inch. Preferably, and as shown in FIG. 9, the outer free end 31 of the other segment 50 of the other elastic fabric panel has an approximately one-half inch strip of metal hook tape 37, that is sonic sealed, containing one row of four hooks which are spaced apart by about three-quarters of an inch. These hooks and loops, when combined, provide maximum security, support and comfort to the wearer. One embodiment of the garment which is removably attachable at the front consists of a one-inch to one-and-one-half inch loop tape 35, which contains multiple vertical rows of loops, with each vertical row of loops containing four loops, with each of the vertical rows of loops being spaced apart by approximately one-half inch. This embodiment provides an adjustable garment which provides maximum security, comfort, and support to the wearer. The tapes 35 and 37 are preferably attached to the outer free ends 31 of the segments 50 of the elastic fabric panels by a narrow zig-zag stitch from a sewing machine that is tacked in each corner.

All embodiments of the active-wear garment 16 have at least two shoulder straps, a first shoulder strap and a second shoulder strap. Each shoulder strap may be a continuous strap joining an extension upward from segment 50 to an upward extension of segment 52 and merging on the wearer's shoulder blade, or, as is shown in FIGS. 2 and 3, may be comprised of a front shoulder strap 24 which is removably attachable to a back shoulder strap 32. Each front shoulder strap 24 or front segment of a one-piece shoulder strap (hereinafter "front shoulder strap") is an extension upward from the upper portion of segment 50 of the elastic fabric panel 20 extending over the shoulder, and removably attaches with a back shoulder strap 32 or back segment of the one-piece shoulder strap (hereinafter "back shoulder strap") present at the upper portion of segment 52 of the broad bands of elastic fabric 33 on the back part of the active-wear garment 16 (FIG. 2). The front shoulder strap 24 has a first segment of the shoulder strap which is an upward extension of segment 50. The back shoulder strap 32 has a second segment of the shoulder strap which is an upward extension of the broad band of elastic fabric 33, or segment 52. Each back shoulder strap 32 is an extension upward from the upper portion of segment 52 of the broad band of elastic fabric 33 extending upward, and removably attaches with the front shoulder strap 24 present at the upper portions of segment 50 of the elastic fabric panel 20 on the back part of the active-wear garment 16 (FIG. 2).

Each of the front shoulder straps 24 and back shoulder straps 32 is preferably comprised of two layers of wickable fabric, the outer fabric, which is preferably Meryl™ fabric, and the fabric used for the lining 46, which is preferably the Cool Max™ fabric. Each margin of the front shoulder straps 24 and back shoulder straps 32 is preferably bordered along the entire length of the shoulder strap, 24 front shoulder strap and 32 back shoulder strap, with woven elastic bands 26 which are preferably sewn through the layer of Meryl™ fabric and the layer of Cool Max™ fabric along the side of the front shoulder strap 24 and back shoulder strap 32 that touches the wearer's body (FIG. 6).

The portion of the shoulder straps 24 which rest at the top of the wearer's shoulders is preferably wide enough to prevent the shoulder straps from slipping on the wearer's shoulders. This portion of the shoulder straps 24 may range in width from about one inch to about two inches, and is preferably about one and one-half inches. It has been shown that such an arrangement and width of the shoulder straps 24 provides for non-slippage of the shoulder straps, front 24 and back 32, during physical activity and during everyday activities, a problem often encountered with known active-wear and shape-wear garments in general. Thus, wider shoulder straps, front 24 and back 32, having the approximately three-quarter inch woven elastic bands 26 sewn along each border, enhances the stability of the shoulder straps, front 24 and back 32, which results in the non-slippage of the shoulder straps, front 24 and back 32, during any activity. In all of the embodiments of the garment 16 of the invention, whether the front shoulder straps 24 are permanently or removably attached to the back shoulder straps 32 of the garment 16, the shoulder straps are preferably cushioned to provide comfort to the wearer's shoulders by presence of the woven elastic bands 26 which are plush, woven elastic bands attached to the side of the garment 16 which touches the wearer's skin FIG. 6. The presence of the plush, woven elastic bands 26 next to the wearer's skin on the front 24 and back 32 shoulder straps is a quality which conveys comfort to the wearer. This is especially noticeable in the embodiments of the invention in which the front 24 shoulder straps and the back 32 shoulder straps are removably attachable, as the active-wear garments of the prior art generally do not have a plush cushion for the site of attachment of removably attachable straps. In permanently or removably attachable straps of the prior art, the method of attachment or adjustment often includes a metal or plastic ring which touches the wearer's skin, and, upon movement of the wearer, may cause discomfort. Thus, the plush woven elastic bands 26 which touch the wearer's skin at the site of removable attachment of the front shoulder straps 24 and the back shoulder straps 32 is superior to methods of removable attachment in the prior art.

If the front shoulder straps 24 are removably attachable to the back shoulder straps 32 (FIG. 2) formed from the upper portions of segments 52 of the broad bands of elastic fabric 33 in the rear portion of the active-wear garment 16 (the portion which rests upon the wearer's back), they are removably attachable at the outer free ends of the shoulder straps 80. The front shoulder straps 24 may be removably attached with the back shoulder straps 32 by any of the methods described hereinabove for removably attaching two parts of the active-wear garment 16 together. As is shown in FIG. 2, a metal loop tape 72 having a series of rows of two loops attached at the ends of the front shoulder straps 24 permits the front shoulder straps 24 to be adjustably adjoined with a metal hook tape 74 containing two hooks present at the ends of the back shoulder straps 32. Thus, each front shoulder strap 24, and each back shoulder strap 32, can be attached to one another at the outer free ends of the shoulder straps 80. In addition, each front shoulder strap 24, and each back shoulder strap 32, can be adjusted by adjusting the locations where the hooks present on the metal hook tape 74 are attached with the loops present on the metal loop tape 72, or by other mechanisms, for the adjustable support and comfort of the wearer. In this embodiment, along segments 48, 50, and 52 is a top border 58 that extends from tape 74 on the back straps 32 to the end of the front shoulder strap 24. Furthermore, top border 58 extends from the end of a first front shoulder strap 24 to the end of a second front shoulder strap 24. In addition, the top border 58 continues from tape 74 on back shoulder strap 32 to the outer free ends 30 of the broad band of elastic fabric 33.

As shown in FIG. 1, the two segments 50 of the two elastic fabric panels 20 present in the active-wear garment 16 are preferably permanently attached to each other, forming a seam 56. In order to provide further support to the breasts and to separate the breasts, it is desirable to attach along the length of seam 56, preferably on the inside of the active-wear garment 16 (which faces the wearer's body) and over the lining 46, a support stay 78, constructed from solid or tubular plastic, metal or the like (shown in FIG. 6). The support stay 78 is preferably from about three and one-quarter to about four and one-half inches in length, from about three-sixteenths inch to about one-half inch in width, and from about one-half inch to about one and three-eighths in thickness. To enhance the comfort of the support stay 78, the support stay 78 is preferably enclosed within a casing of material, such as woven cotton, which is partially or fully covered by a layer of polyester plush material, such as tricot. Both ends of the support stay 78 are sewn beneath and tucked within the three-quarter inch woven elastic band 26 of the top border 58 of the garment 16 and the three-quarter inch woven elastic band 26 of the bottom border 64 of the garment 16, so as not to cause any discomfort to the wearer (shown in FIG. 6).

The active-wear garment of the present invention may be constructed in the manner described below. However, other methods for constructing the active-wear garment may also be employed.

As described hereinabove, some of the materials utilized to construct the active-wear garment of the present invention are available through Guilford Mills. Other materials are available at fabric manufacturers such as Darlington Fabrics (New York, N.Y.), A.B.C. Fabrics (New York, N.Y.), and S.M.S. Industries (New York, N.Y.), as is known to those of skill in the art. The polymer tubing for the preferred support wire is available from scientific suppliers known by those of skill in the art and hardware stores. Memory metal alloy wires are available from B.P.A. Nitinol Wire, Inc., U.S. Nitinol, and Cordis Corporation.

Paper pattern pieces for the active-wear garment may be constructed using the drawings set forth herein as a guide, and may be placed upon the fabrics of choice to illustrate how to cut out the different pieces of fabric used for the construction of the different parts of the active-wear garment. To construct the one piece contoured cups, it may be necessary to have the cup pieces molded as known by those of skill in the art from the fabric of choice, preferably Meryl™ fabric and Cool Max™ fabric. (The two- or more-piece contoured cups do not require molding to achieve their contoured shape.) Once the pieces of fabric are cut out, they may be pinned together and assembled by stitching or any other method as described herein, using the drawings set forth herein as a guide. Where there are two counterpart components to the garment, such as the two cups, hereinafter, the assembly of only one of those components is described, and it is implicit in this detailed description that the counterpart component is likewise assembled.

In a two-piece cup active-wear garment as shown in FIG. 1, the outer layer of fabric of the upper portion of the cup 34 is single needle stitched to the outer layer of the lower portion of the cup 36, forming outer seam 38 and the outer layer of the cup 18. Single needle stitching is known to those of skill in the art and results in a single row of stitches. The number of stitches per inch using single needle stitching may range from about twelve stitches per inch to about sixteen stitches per inch, and preferably twelve stitches per inch are made. The lining layer of fabric of the upper portion of the cup 34 is single needle stitched to the lining layer of the lower portion of the cup 36, forming inside seam 38 and the lining layer of the cup 18. The lining and the outer layer of the cup 18 are stitched together in the following manner: cup seam 38 is cover stitch top-stitched on both the outer layer of the cup 18 and the lining layer of the cup 18. Cover stitch top-stitching is a type of stitching known to those of ordinary skill in the art. The number of stitches per inch using this method may range from about twelve stitches per inch to about sixteen inches per inch and preferably twelve stitches per inch are made.

To construct the elastic fabric panel, the raw edges of the three layers of segment 48 are basted together by placing the outer layer of segment 48 on top of the power net fabric layer, which is the middle of three layers, and which is placed on top of the lining layer 46 of segment 48. Basting is a type of stitching known to those of skill in the art. The next step is to single needle stitch the cup 18 to segment 48 by placing the lower edge of the outer layer of the cup 18 next to the upper edge of the outer layer of segment 48 and the lower edge of the lining layer of the cup 18 next to the upper edge of the lining layer of segment 48. This forms seam 45, and is the basis for the casing to hold the arcuate support wire in place. After sewing seam 45, single needle stitching is performed one-eighth inch from the raw edge of the five layers of fabric sewn together by seam 45. The UNPUNCHABLES™ fabric is preferably cut into a one and one-half inch bias strip. The UNPUNCHABLES™ bias strip is fed through a folder which is attached to a single needle machine and the folder wraps the raw edges of the UNPUNCHABLES™ strip inside and the single needle stitching sets the UNPUNCHABLES™ strip in place thereby creating a channel casing 42. The channel casing 42 consists of the UNPUNCHABLES™ strip surrounding the five layers of fabric (seam allowances) sewn together by seam 45. The support wire is inserted into the tube formed by the channel casing 42 by inserting the support wire into the space between the second and third seam allowances of these five seam allowances.

Alternatively, the support wire 22 may be encased in a tube of fabric, a fabric tape, or the like in any manner which securely affixes the support wire 22 to the lower arcuate edge of the cup 18 such that the support wire provides flexible support for the breast when the garment is placed upon the wearer.

Using a single needle stitch, the upper portion and the portion closest to the wearer's sternum of cup 18 is stitched to segment 50 by sandwiching the outer layer and lining layer of cup 18 between the outer layer of segment 50 and the lining layer of segment 50, thereby creating seam 62. Using a single needle stitch, segment 52 is stitched to segment 48 by placing both the outer layer and the lining layer of segment 48 between the outer layer of segment 52 and the lining layer of segment 52. The seam thereby formed is seam 54.

The plush, woven elastic band 26 is then stitched along the raw edges of both the lining fabric and the outer layer fabric by laying the elastic along the edges of the outer layer fabric segments along the top raw edges of segments 48, 50, and 52. The mini zig-zag stitch can be about one-sixteenth to about one-quarter of an inch in width, and is preferably one-eighth of an inch in width. To perform a mini zig-zag stitch, stitch through the elastic along the raw edges of the named fabric segments. The elastic is thus stitched to the top raw edges of segments 52, 48, and 50. The plush, woven elastic band 26 is turned to the inside of the garment at all edges heretofore described. A mini zig-zag stitch is applied about five-eighths to three-quarters of an inch from the outer margin of the top margins of the active-wear garment. A zig-zag stitch will be apparent on the outer surface of the garment.

The right side of the garment (when viewing the front of the garment) is attached to the left side of the garment using a single needle stitch by stitching the segment 50 which will support the left breast when placed on the wearer to segment 50 which will support the right breast when placed on the wearer, thereby creating seam 56. The selvages resulting from the formation of seam 56 are pressed open, and the support stay 78 which is encased in a tube of polyester tricot or velush is placed over seam 56 on the inside of the active-wear garment. Using a two-needle topstitch, stitches are placed along each edge of the support stay and are visible on the outside of the center front of the active-wear garment. To perform this stitch, stitches are made in an upward direction from the bottom raw edge of segment 48, to the top margin of segments 50. This stitching will go through the elastic along the top margin of segments 50. A very short seam is used to tack the top finished margin of the juncture of segments 50 through the support stay 78.

Using a mini zig-zag stitch, the elastic 26 is stitched along the raw edges of both the lining fabric and the outer layer fabric by laying the elastic along the outer layer bottom raw edge of segments 52, 50 and 48. The elastic band 26 is turned to the inside of the garment along the bottom edges of garment, thus encasing the bottom edge of the support stay. Using a mini zig-zag stitch, stitches are placed through this elastic band 26, the lining layer 46, and the outer layer of segments 48, 50 and 52 along the bottom margin of the garment approximately five-eighths to three-quarters of an inch from the bottom margin of the garment. A zig-zag stitch will be visible on the side of the garment that does not touch the wearer's skin when placed upon a wearer.

To construct a garment that is removably attachable at the center back of the garment, that is, at the broad band of elastic fabric 33, a mini zig-zag stitch is used to attach the hook tape 70 to the raw edge of the portion of the broad band of elastic fabric 33 that sits on the right of the wearer's back (when facing wearer's back). In addition, a mini zig-zag stitch is used to attach the eye tape 68 to the raw edge of the portion of the broad band of elastic fabric 33 that sits on the left of the wearer's back (when facing wearer's back).

To construct a garment that is removably attachable at the center front of the garment, as shown in FIG. 9, at the free end 31 of the center front of the garment which is closest to the wearer's left breast, a mini zig-zag stitch is used to attach the eye tape 35 to the raw edge of the right elastic fabric panel (when facing the wearer's chest). In addition, at the free end 31 of the center front of the garment that is closest to the wearer's right breast, a mini zig-zag stitch is used to attach the hook tape 37 to the raw edge of the left elastic panel (when facing the wearer's chest).

To construct a garment that is removably attachable at the shoulder straps, a mini zig-zag stitch is used to attach a hook tape 74 to finish off the raw edges of the back shoulder strap 32. In addition, a mini zig-zag stitch is used to attach an eye tape 72 to finish off the raw edges of the front shoulder strap 24. To finish off and secure all components that result in removable attachability of the active-wear garment, the corners of all hook and eye tapes are tacked using very small stitches.

In addition to the preferred embodiment of the invention described hereinabove, and shown in the drawings, there are several other embodiments of the invention.

Figure 7:
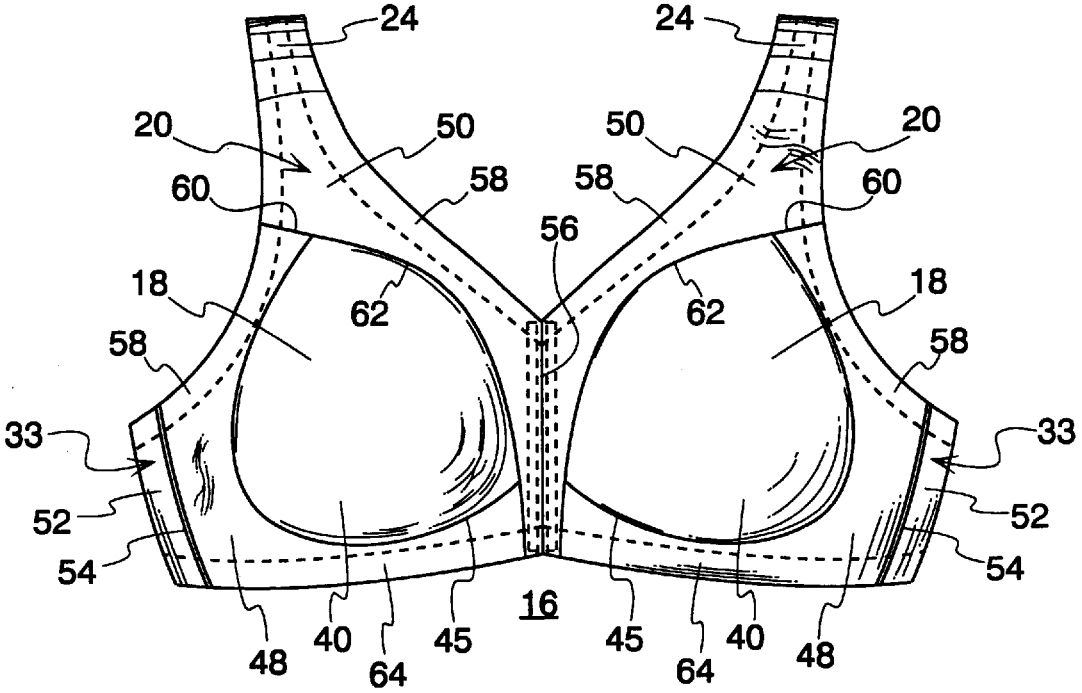
FIG. 7 is a front elevational view of another preferred embodiment of an active-wear garment of the present invention, which has cups formed of a single piece of fabric.

Another embodiment shown in FIG. 7 of the active-wear garment 16 of the invention 16 is the same as the embodiment described above except it has single-piece, non-seamed contoured bra cups 18 attached to a pair of elastic fabric panels 20 which support the breasts, all of which are also made of stretch elastic fabric as described hereinabove.

Yet another embodiment of the active-wear garment 16 of the invention is one in which the contoured cups 18 are made of more than two pieces of fabric.

Figure 8:
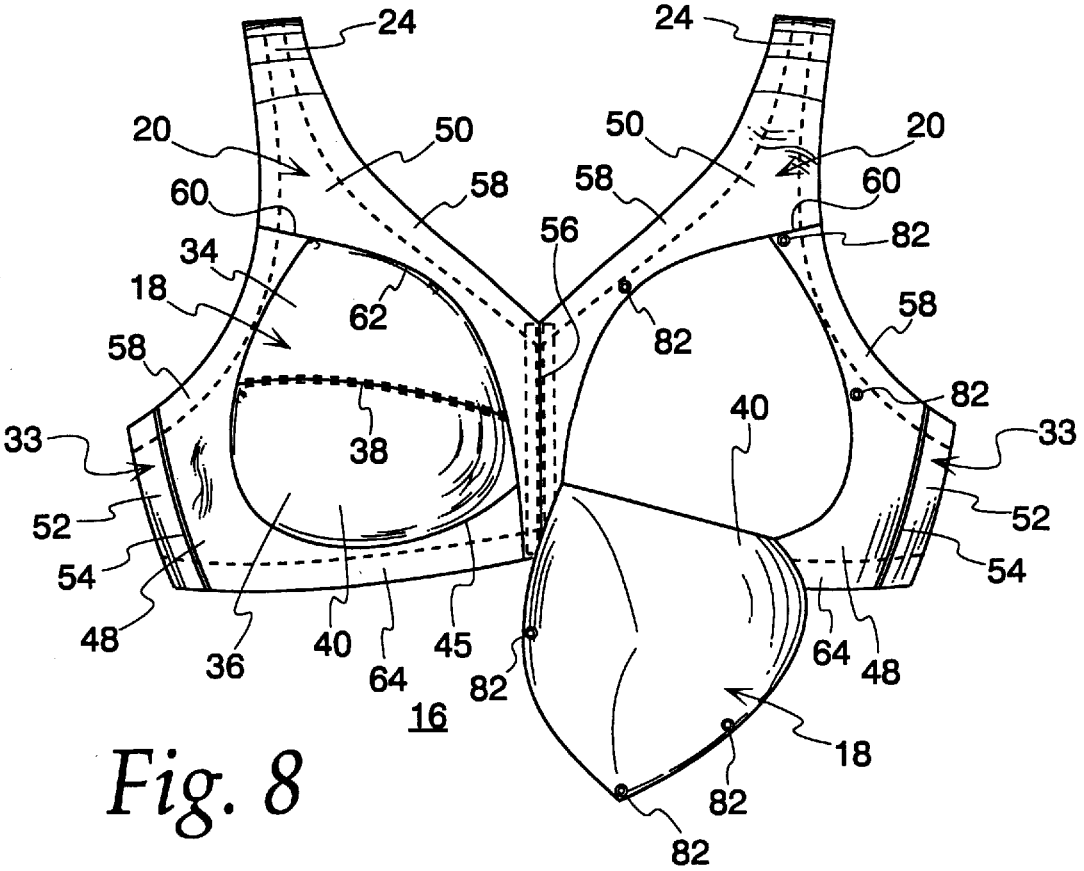
FIG. 8 is a front elevational view of another preferred embodiment of the active-wear garment of the present invention which has two removably attachable cups to facilitate exposure of the breast while the garment is being worn.

Another embodiment shown in FIG. 8 of the active-wear garment 16 of the invention includes any of the cups 18 described above, but which are partially or fully removably attached to the active-wear garment 16 for the convenient exposure of the breasts during the breastfeeding of children Where the cups 18 are partially removably attached (see FIG. 8) to the active-wear garment 16, generally the lower area 40 of the cups 18 will be non-removably attached to the active-wear garment 16 (by gluing, sewing or like methods), and the remainder of the cups 18 will be removably attached to the active-wear garment. Where the cups 18 are fully removably attached to the active-wear garment 16, no portion of the cups 18 will be nonremovably attached to the active-wear garment 16 (i.e., the entirety of the cups 18 will be removably attached to the active-wear garment 16). Any conventional means of garment attachment 82, such as metal or plastic hooks and eyes having a series of loops or a series of hooks, strips or patches of Velcro®, buttons and button holes or snaps may be conveniently used to removably attach any margin (periphery or other convenient portion) of the cups 18 to the active-wear garment 16, at one, two or multiple convenient locations 82. In FIG. 8, cups 18 which are partially or fully detachable allow the wearer to conveniently nurse an infant while wearing the garment, or to wear the active-wear garment during periods between nursing sessions. Such cups 18 advantageously shape and control movement of the breasts, and provide the wearer with a comfortable and natural fit, especially while the wearer is physically active, while providing ease of access of the breasts to an infant during periods of nursing.

Still another embodiment shown in FIG. 10 of the active-wear garment 16 of the invention includes either multiple-piece or single-piece contoured bra cups 18 attached to a pair of elastic fabric panels 20 which support the breasts, all of which are made of stretch elastic fabric. This embodiment of the garment is either permanently or removably attached to the upper body portion of a women's swimsuit structure. Such swimsuit may be one piece as shown in FIG. 10 or two or more pieces.

Yet another embodiment of the invention allows the active-wear garment of the invention 16 to be used in either day or evening wear as a support structure attached within an outerwear garment. For day or evening wear, this embodiment of the invention may be attached as an active-wear garment for women in a daywear dress, evening dress, tank top, blouse, T-shirt or other top.

While the invention has been shown illustrated, described and disclosed in terms of embodiments or modifications which it has assumed in practice, the scope of the invention should not be deemed to be limited by the precise embodiments or modifications herein shown illustrated, described and disclosed, such other embodiments or modifications intended to be reserved especially as they fall within the scope of the claims here appended.

What is claimed is:

1. An active-wear garment which comfortably provides support for the breasts and back of a wearer comprising:

a pair of contoured cups formed from elastic fabric which is sized so as to overlie, snugly encase and support a wearer's breasts;

an elastic fabric panel surrounding each of said cups, wherein each elastic fabric panel is interconnected with a respective cup and the other respective elastic fabric panel so as to form a front section of said active-wear garment;

a flexible, arcuate support wire fixedly positioned along a lower peripheral edge of each of said cups, each said support wire extending along an arc of between about 100° and about 135°;

a pair of shoulder straps which merge with upper side portions of said elastic fabric panels and upper side portions of a broad band of elastic fabric;

a pair of elastic bands which extend along the opposing side margins of each of said shoulder straps, and along upper margins of said elastic fabric panel surrounding a respective one of said cups, so as to form a tear-drop, shape with said respective cup;

a broad band of elastic fabric extending between and connected to the side margins of said front section of said active-wear garment, said broad band of elastic fabric being of a length such that it firmly and snugly fits around the upper back of a wearer when the active-wear garment is worn.

2. An active-wear garment as set forth in claim 1, wherein said broad band of elastic fabric includes:

a pair of broad bands of elastic fabric, each said broad band extending from, and connected with a respective one of the outwardly facing side margins of a respective elastic fabric panel; and means for removably attaching the outer free ends of said broad bands of elastic fabric together to thus form a back end of an upper torso band having a length such that, when interconnected, it firmly and snugly fits around the upper part of the back of a wearer.

3. An active-wear garment as set forth in claim 2 which further includes a pair of elastic bands which extend along the upper and lower margins respectively of each of the broad bands of elastic fabric, and along the upper and lower margins of a respective elastic fabric panel surrounding a respective one of said cups, to help stabilize a respective breast in said respective cup while the active-wear garment is placed on a wearer and the wearer is active.

4. An active-wear garment as set forth in claim 3, wherein each respective shoulder strap of said pair of shoulder straps is formed by:

two removably attachable segments, a front segment which comprises an upward extension of the elastic fabric panel and which extends upwardly from a wearer's chest over a wearer's shoulder, and a back segment which comprises an upward extension of the broad band of elastic fabric which rests upon a wearer's back, each of which respective segment removably attaches to the other respective segment on the upper back of the wearer.

5. An active-wear garment as set forth in claim 4, wherein each respective pair of segments of the shoulder strap, a front segment and a back segment, are removably attachable to one another at the end of the upward extension of the back segment from the broad band of elastic fabric, which is at a site on the wearer's back wherein movement by the wearer when wearing the active-wear garment results in comfortable wear at least along the length of the shoulder strap and at least along the length of the elastic fabric panels which are connected to the broad band of elastic fabric.

6. An active-wear garment as set forth in claim 5, wherein each respective contoured cup, the respective elastic fabric panel surrounding each contoured cup, and the broad band of elastic fabric described therein, are formed of moisture-wicking elastic fabric which has the capacity to wick moisture off the skin of the wearer.

7. An active-wear garment as set forth in claim 6, wherein the arcuate support wire is formed of a polymer.

8. An active-wear garment as set forth in claim 7, wherein a site at which a free end of the front shoulder strap, which is the segment of the shoulder strap which is nearest the wearer's skin upon removable attachment of the respective segments of the shoulder strap, has a pair of opposing plush woven elastic bands on a side of said shoulder strap that rests upon a wearer's skin, and said plush woven elastic bands convey comfort to the wearer.

9. An active-wear garment as set forth in claim 8, wherein a support stay is positioned at a center front juncture of said two elastic fabric panels, and said support stay serves to separate and immobilize the breasts of the wearer.

10. An active-wear garment as set forth in claim 9, wherein the site of removable attachment of said shoulder strap rests at the site on a wearer's shoulder blade such that movement of the upper torso, shoulder and arm of the wearer does not cause the site of removable attachment of said respective shoulder strap to irritate or cause abrasion on a surface of the skin of the wearer.

11. An active-wear garment as set forth in claim 2, wherein the shoulder straps are non-removably attachable.

12. An active-wear garment as set forth in claim 6, wherein the arcuate support wire is formed of a metal alloy.

13. An active-wear garment of claim 1 wherein said active-wear garment is removably attachable at a center front location, which is a site of juncture of said two elastic fabric panels.

14. An active-wear garment of claim 4 wherein said contoured cups are formed in the shape of an oval.

15. An active-wear garment as set forth in claim 6, wherein said arcuate support wire is fixedly positioned by use of an arcuate support wire channel casing.

16. An active-wear garment as set forth in claim 15, wherein s aid active-wear garment is fully lined by a moisture-wicking fabric.

17. An active-wear garment as set forth in claim 10, wherein all raw edges of garment material are encased within said active-wear garment such that no raw edge is exposed on either an exterior surface or an interior surface of said active-wear garment.

18. An active-wear garment comprising a pair of elastic fabric panels, each of which surrounds and connects with a contoured cup which is formed to encase a wearer's breast; a flexible, arcuate support wire, fixedly positioned along a lower peripheral margin of each of said cups; two shoulder straps, each of which comprises a first segment which extends upwardly from a respective elastic fabric panel and is adapted to extend over a wearer's shoulder to removably attach to a second segment of said shoulder strap which extends upwardly from a laterally extending broad band of elastic fabric which is adapted to rest on a wearer's back and which is connected to a respective elastic fabric panel at a respective site which is adapted when the active-wear garment is worn to be adjacent to one side of a wearer's torso, wherein:

each elastic fabric panel comprises two respective segments, a first segment and a second segment, wherein said first segment includes a first margin which extends along the lower and outside margins of a respective cup;

a second margin which connects with said second segment along a margin of said first segment that is situated closest to a wearer's sternum;

a third margin which forms a portion of a bottom border of said active-wear garment;

a fourth margin which extends to and connects with a side margin of said broad band of elastic fabric;

a fifth margin which forms a portion of a top border of said active-wear garment which is adapted to rest under an arm of a wearer; and a sixth margin which is connected to and forms a margin with said second segment along a margin of said first segment that is distant from a wearer's sternum;

said second segment includes a first margin which forms a margin along said first segment of said elastic fabric panel which is distant from the wearer's sternum, which margin extends along and is connected to an upper portion of said respective cup and a portion of said respective cup which is closest to a wearer's sternum and which margin extends along and is connected to said first segment of said elastic fabric panel at a margin of said first segment that is closest to a wearer's sternum;

a second margin which forms a portion of said bottom border of said active-wear garment;

a third margin which extends along a center front seam of said active-wear garment which forms a juncture of two said respective elastic fabric panels;

a fourth margin which forms a portion of a top border of said active-wear garment which extends in an upward direction along a margin of and forms a margin of a first segment of a respective front shoulder strap, which margin is adapted to be closest to a wearer's head;

a fifth margin which comprises a free end of said respective front shoulder strap;

a sixth margin which forms a portion of said top border of said active-wear garment which extends in an upward direction and forms a margin of a first segment of a respective front shoulder strap which is positioned to be farthest from a wearer's head;

each contoured cup of two respective contoured cups comprises two respective margins wherein:

said first margin extends along a border of said contoured cup which is closest to a wearer's sternum and extends upward to an upper portion of said contoured cup; and said second margin extends from an upper portion of said contoured cup downward along a border of said contoured cup which is distant from a wearer's sternum and extends along a bottom border of said contoured cup to a position wherein said second margin forms a juncture with said first margin of said contured cup at a bottom margin of said contoured cup nearest a wearer's sternum;

said flexible, arcuate support wire extends along an arc of between about 100° and about 135°;

said broad band of elastic fabric includes a first margin which includes a portion of said bottom border of said active-wear garment;

a second margin which extends to and connects with said fourth margin of said first segment of a respective elastic fabric panel;

a third margin includes a top border of said active-wear garment, from which margin extends upwardly a second segment of a respective pair of back shoulder straps;

a fourth margin which includes a free end of said respective back shoulder strap;

a fifth margin which includes a top border of said active-wear garment, from which margin extends upwardly each second segment of a respective pair of back shoulder straps.

19. An active-wear garment as set forth in claim 18, wherein said broad band of elastic fabric includes:

a pair of broad bands of elastic fabric, each said broad band extending from, and connected with a respective one of the outwardly facing side margins of a respective elastic fabric panel; and means for removably attaching the outer free ends of said broad bands of elastic fabric together to thus form a back end of an upper torso band having a length such that, when interconnected, it firmly and snugly fits around the upper part of the back of a wearer.

20. An active-wear garment as set forth in claim 19 which further includes a pair of elastic bands which extend along the upper and lower margins respectively of each of the broad bands of elastic fabric, and along the upper and lower margins of a respective elastic fabric panel surrounding a respective one of said cups, to help stabilize a respective breast in said respective cup while the wearer is active.

21. An active-wear garment as set forth in claim 20, wherein each respective shoulder strap of said pair of shoulder straps is formed by:

two removably attachable segments, a front segment which comprises an upward extension of the elastic fabric panel and which extends upwardly from a wearer's chest over a wearer's shoulder, and a back segment which comprises an upward extension of the broad band of elastic fabric which rests upon a wearer's back, each of which respective segment removably attaches to the other respective segment on the upper back of the wearer.

22. An active-wear garment as set forth in claim 21, wherein each respective pair of segments of the shoulder strap, a front segment and a back segment, are removably attachable to one another at the end of the upward extension of the back segment from the broad band of elastic fabric, which is at a site on the wearer's back wherein movement by the wearer when wearing the active-wear garment results in comfortable wear at least along the length of the shoulder strap and at least along the length of the elastic fabric panel joined to the broad band of elastic fabric.

23. An active-wear garment as set forth in claim 22, wherein the arcuate support wire is formed of a polymer.

24. An active-wear garment as set forth in claim 20, wherein the shoulder straps are non-removably attachable.

25. An active-wear garment as set forth in claim 23, wherein said arcuate support wire is fixedly positioned by use of an arcuate support wire channel casing.

26. An active-wear garment as set forth in claim 25, wherein each respective contoured cup, the respective elastic fabric surrounding each contoured cup, and the broad band of elastic fabric described therein, are formed of moisture-wicking elastic fabric which has the capacity to wick moisture off the skin of the wearer.

* * * * *

UNITED STATES PATENT AND TRADEMARK OFFICE

CERTIFICATE OF CORRECTION

PATENT NO. : 5,873,768

DATED : February 23, 1999

INVENTOR(S) : Edie Fleischman-Ament

It is certified that error appears in the above-indentified patent and that said Letters Patent is hereby corrected as shown below:

Claim 16, Column 20, Line 25; change "s aid" to --said--.

Signed and Sealed this

Third Day of August, 1999

*Attest:*

Q. TODD DICKINSON

*Attesting Officer*

*Acting Commissioner of Patents and Trademarks*